US005294328A

United States Patent [19]

Schmidt et al.

[11] Patent Number: 5,294,328

[45] Date of Patent: Mar. 15, 1994

[54] PRODUCTION OF REFORMULATED GASOLINE

[75] Inventors: Robert J. Schmidt, Barrington; Paula L. Bogdan; J. W. Adriaan Sachtler, both of Des Plaines; Srikantiah Raghuram, Buffalo Grove, all of Ill.

[73] Assignee: UOP, Des Plaines, Ill.

[21] Appl. No.: 922,935

[22] Filed: Jul. 31, 1992

Related U.S. Application Data

[63] Continuation-in-part of Ser. No. 528,403, May 24, 1990, Pat. No. 5,135,639.

[51] Int. Cl.[5] ..... C10G 37/10

[52] U.S. Cl. ..... 208/66; 208/62; 585/737

[58] Field of Search ..... 208/62, 66; 585/737

[56] References Cited

U.S. PATENT DOCUMENTS

| | | | |
|---|---|---|---|
| 2,943,037 | 6/1960 | Woodle | 200/79 |
| 2,946,766 | 7/1960 | Maffal et al. | 208/65 |
| 3,001,927 | 9/1961 | Gerhold et al. | 208/64 |
| 3,280,022 | 10/1966 | Engel | 208/64 |
| 3,755,140 | 8/1973 | Pollitzer | 208/62 |
| 4,457,832 | 7/1984 | Robinson | 208/66 |
| 4,804,802 | 2/1989 | Evans et al. | 208/310 |
| 4,911,822 | 3/1990 | Franck et al. | 208/66 |
| 5,135,639 | 8/1992 | Schmidt et al. | 208/66 |

*Primary Examiner*—Helane Myers

*Attorney, Agent, or Firm*—Thomas K. McBride; John F. Spears, Jr.; Richard E. Conser

[57] ABSTRACT

A process combination is disclosed to reduce the aromatics content of a key component of gasoline blends. Paraffins contained in catalytic reformates are conserved and upgraded by separation and isomerization, reducing the reforming severity required to achieve a given product octane with concomitant reduction in paraffin aromatization and cracking. Light reformate may be separated and isomerized, and heavier paraffins are separated from the reformate by solvent extraction or adsorption; the recovered heavy paraffins are isomerized, optionally at a substoichiometric hydrogen ratio. A gasoline component having a reduced aromatics content relative to reformate of the same octane number is blended from the net products of the separation and isomerization steps.

20 Claims, 2 Drawing Sheets

PRODUCTION OF REFORMULATED GASOLINE

CROSS REFERENCE TO RELATED APPLICATION

This application is a continuation-in-part of prior copending application Ser. No. 528,403, the contents of which are incorporated herein by reference thereto now U.S. Pat. No. 5,135,639.

BACKGROUND OF THE INVENTION

1. Field of the Invention

This invention relates to an improved process combination for the conversion of hydrocarbons, and more specifically for the upgrading of a naphtha stream by a combination of reforming with reformate separation and paraffin isomerization.

2. General Background

The widespread removal of lead antiknock additive from gasoline and the rising fuel-quality demands of high-performance internal-combustion engines have compelled petroleum refiners to install new and modified processes for increased "octane," or knock resistance, in the gasoline pool. Refiners have relied on a variety of options to upgrade the gasoline pool, including higher-severity catalytic reforming, higher FCC (fluid catalytic cracking) gasoline octane, isomerization of light naphtha and the use of oxygenated compounds. Such key options as increased reforming severity and higher FCC gasoline octane result in a higher aromatics content of the gasoline pool, through the production of high-octane aromatics at the expense of low-octane heavy paraffins. Current gasolines generally have aromatics contents of about 30% or higher, and may contain more than 40% aromatics.

Currently, refiners are faced with the prospect of supplying reformulated gasoline to meet tightened automotive emission standards. Reformulated gasoline would differ from the existing product in having a lower vapor pressure, lower final boiling point, increased content of oxygenates, and lower content of olefins, benzene and aromatics. The aromatics content may be lowered over several years to a maximum of as low as 20%.

Since aromatics have been the principal source of increased gasoline octanes during the recent lead-reduction program, severe restriction of the aromatics content will present refiners with processing problems. Currently applicable technology includes such costly steps as recycle isomerization of light naphtha and generation of additional light olefins and isobutane as feedstock to an alkylation unit. Increased allowable oxygenates will help, but novel processing technology is needed.

RELATED ART

Process combinations for the upgrading of naphtha to yield gasoline are known in the art. These combine known and novel processing steps primarily to increase gasoline octane, most often by producing and/or recovering aromatics.

A combination process for upgrading reformate is taught in U.S. Pat. No. 3,001,927 (Gerhold et al.). The reformate is solvent extracted, and paraffinic raffinate is fractionated to separate a light fraction to isomerization and a heavy fraction which is recycled to reforming. Isomerate is separated by molecular-sieve adsorption into isoparaffins to gasoline blending and normal paraffins recycled to the raffinate fractionator. Gerhold et al. does not disclose the present process combination, however, nor would it achieve the present reduction in aromatics content at constant octane number of the gasoline product.

U.S. Pat. No. 3,280,022 (Engel et al.) teaches separate reforming of low- and high-end-point naphtha, solvent extraction, and fractionation of raffinate into a $C_6$ and lighter stream to isomerization and a heavier stream to the high-end-point naphtha reformer. U.S. Pat. No. 3,502,570 (Pollitzer) discloses the separation of reformate into $C_5/C_6$, $C_7$, and $C_8+$ fractions with isomerization of the $C_5/C_6$ fraction and reblending of the isomerate with the $C_8+$ fraction. U.S. Pat. No. 3,761,392 (Pollock) teaches separate reforming of $C_6$–$C_8$ and $C_9+$ fractions, solvent extraction, fractionation of the raffinate, isomerization of the $C_5/C_6$ and dehydrocyclization of the $C_7$ + raffinate. U.S. Pat. No. 4,594,145 (Roarty) discloses the aromatization of a $C_6$–$C_7$ fraction, reforming of a $C_7$ fraction, extraction of aromatics from the combined product and recycle of the extraction raffinate to aromatization/reforming. These references neither teach all the elements of nor suggest the present process combination.

U.S. Pat. No. 4,804,802 (Evans et al.) teaches the isomerization of $C_6$ or $C_6+$ normal paraffins followed by separation using multiple molecular sieves to separate successively normal paraffins and mono-methyl-branched paraffins, with recycle of the normal and mono-methyl-branched paraffins to isomerization. U.S. Pat. No. 4,855,530 (LaPierre et al.) discloses the isomerization of $C_7+$ n-alkanes, preferably $C_{10}$–$C_{40}$ n-paraffins to produce a dewaxed low pour point product, with a catalyst comprising a large-pore zeolite. Neither of these patents disclose the process combination of the present invention.

The prior art, therefore, contains elements of the present invention. There is no suggestion to combine the elements, however, nor of the surprising benefits that accrue from the present process combination to produce a gasoline component for reformulated gasoline.

SUMMARY OF THE INVENTION

It is an object of the present invention to provide an improved process combination to upgrade naphtha to gasoline. A specific object is to produce high-octane gasoline having a reduced content of aromatics.

This invention is based on the discovery that a combination of catalytic reforming, selective recovery of paraffin isomers and paraffin isomerization can yield a gasoline component having a reduced aromatics content that may be required in future formulations. The reforming unit operates at lower severities than currently required, preserving heavier paraffins in the product which are recovered and upgraded by isomerization.

A broad embodiment of the present invention is directed to a process combination comprising catalytic reforming of naphtha, separation of a low-octane paraffin fraction from the reformate, isomerization of the low-octane paraffins, and blending of a gasoline component. The low-octane paraffin fraction preferably contains low-branched as well as normal paraffins. Most preferably, the low-octane paraffin fraction is separated by adsorption. Optionally, the isomerization of the low-octane paraffins is carried out at a substoichiometric hydrogen ratio.

Optionally, a light-naphtha fraction is recovered from the reformate and processed in a separate isomerization zone, and the isomerization product may be separated in order to recycle low-octane components.

In an alternative embodiment, FCC gasoline is processed to recover a paraffinic fraction which is additionally isomerized.

These as well as other objects and embodiments will become apparent from the detailed description of the invention.

DESCRIPTION OF THE PREFERRED EMBODIMENTS

To reiterate, a broad embodiment of the present invention is directed to a process combination comprising the catalytic reforming of naphtha, separation of a low-octane paraffin fraction from the reformate, isomerization of the low-octane paraffins, and blending of a gasoline component.

Figure 1:
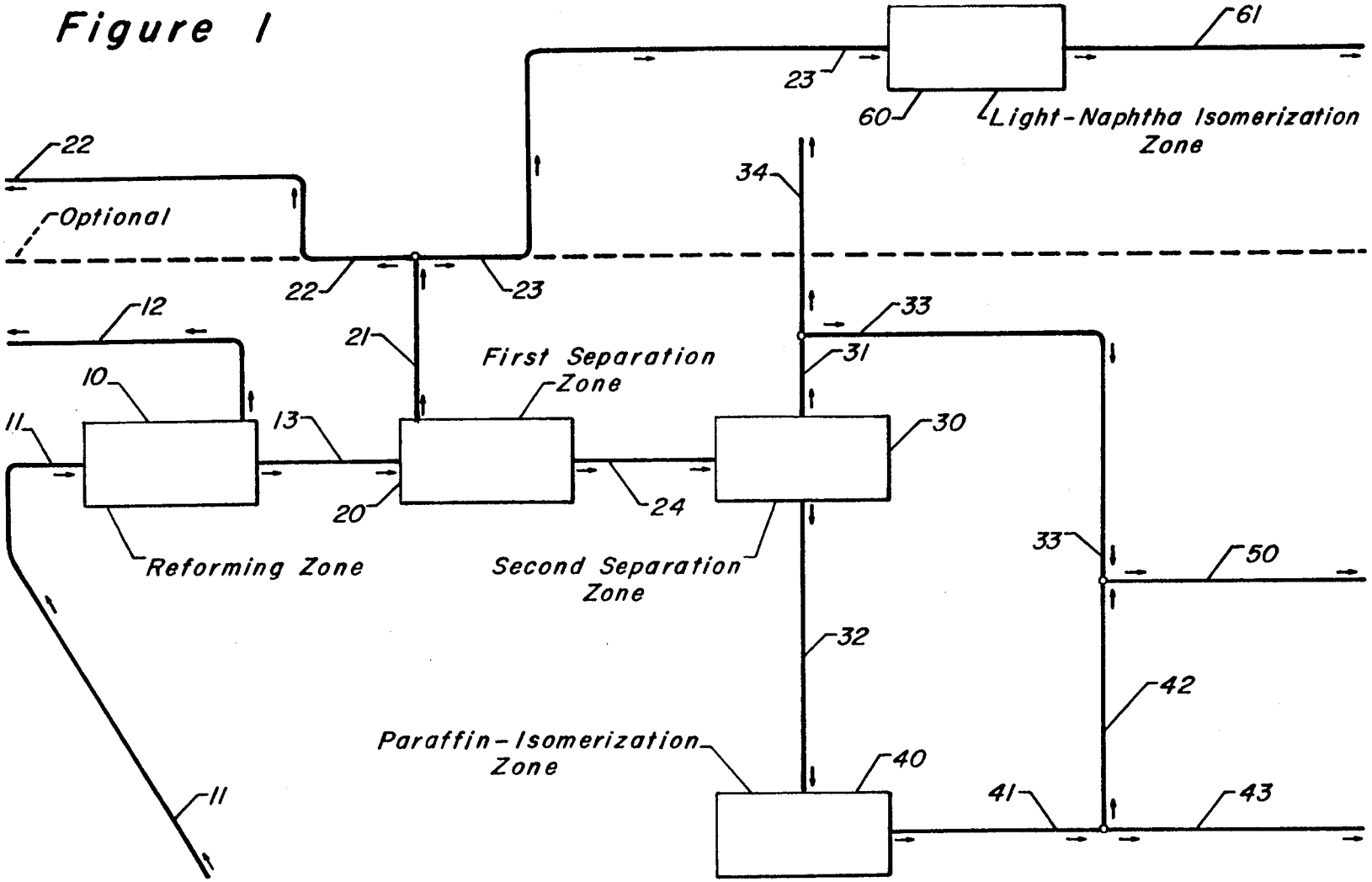
FIG. 1 is a simplified block flow diagram showing the arrangement of the major sections of the present invention.

A review of the block flow diagram FIG. 1 should assist in understanding broad and preferred embodiments of the present invention. Only the major sections and interconnections of the process combination are represented. Individual equipment items such as reactors, heaters, heat exchangers, separators, fractionators, pumps, compressors and instruments are well known to the skilled routineer; description of this equipment is not necessary for an understanding of the invention or its underlying concepts.

A naphtha feedstock is introduced into reforming zone 10 through line 11. The reforming zone produces a hydrogen-rich gas, withdrawn through line 12, and reformate which passes through line 13 to first separation zone 20. Preferably the first separation zone is a reformate-distillation zone comprising fractional distillation to separate light hydrocarbon product from heavy reformate. Light product is withdrawn from the first separation zone through line 21, and may comprise both a normally gaseous fraction in line 22 and a light naphtha fraction in line 23. The normally gaseous fraction comprises butane and lighter hydrocarbons which are in the gaseous state at ambient temperature and atmospheric pressure. The light naphtha fraction comprises pentanes and preferably hexanes in admixture.

Heavy reformate passes from the first separation zone through line 24 to second separation zone 30. The second separation zone may comprise one or both of a solvent-extraction zone and a paraffin-adsorption zone. An aromatic-rich fraction having a relatively high octane number is separated via line 31 from a low-octane paraffin fraction. The low-octane paraffin fraction comprises normal paraffins and optionally low-branched paraffins in admixture.

The low-octane paraffin fraction passes via line 32 to paraffin-isomerization zone 40. The paraffin-isomerization zone produces an isomerized heavy-paraffin product via line 41. At least a portion of each of the aromatic-rich fraction and isomerized heavy-paraffin product are combined to produce a gasoline component 50 via lines 33 and 42, respectively. However, a portion of either or both of the aromatic-rich fraction and isomerized heavy-paraffin product may exit the process combination for other uses via lines 34 and 43, respectively.

The optional light naphtha fraction described hereinabove may pass via line 23 to a light-naphtha isomerization zone 60 to upgrade its octane rating. The light-naphtha isomerization zone may include provisions for separation and recycle of low-octane components, as described hereinafter. The isomerized light product preferably passes via line 61 to gasoline blending.

The naphtha feedstock will comprise paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°-80° C. and a final boiling point of from about 160°-210° C., or it may represent a narrower range with a lower final boiling point.

The naphtha feedstock to the present process generally contains small amounts of sulfur compounds amounting to less than 10 parts per million (ppm) on an elemental basis. Preferably the hydrocarbon feedstock has been prepared from a contaminated feedstock by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB(6) and VIII(9-10) of the Periodic Table. [See Cotton and Wilkinson, *Advanced Organic Chemistry*, John Wiley & Sons (Fifth Edition, 1988)]. Preferably, the pretreating step will provide the first reforming catalyst with a hydrocarbon feedstock having low sulfur levels disclosed in the prior art as desirable reforming feedstocks, e.g., 1 ppm to 0.1 ppm (100 ppb). It is within the ambit of the present invention that the pretreating step be included in the present reforming process.

Operating conditions used in the first reforming zone of the present invention include a pressure of from about atmospheric to 60 atmospheres (absolute), with the preferred range being from atmospheric to 20 atmospheres and a pressure of below 10 atmospheres being especially preferred. Hydrogen is supplied to the first reforming zone in an amount sufficient to correspond to a ratio of from about 0.1 to 10 moles of hydrogen per mole of hydrocarbon feedstock. The volume of the contained first reforming catalyst corresponds to a liquid hourly space velocity of from about 1 to 40 $hr^{-1}$. The operating temperature generally is in the range of 260° to 560° C.

The reforming catalyst is a dual-function composite containing a metallic hydrogenation-dehydrogenation component on a refractory support which provides acid sites for cracking and isomerization. The refractory support of the first reforming catalyst should be a porous, adsorptive, high-surface-area material which is uniform in composition without composition gradients of the species inherent to its composition. Within the scope of the present invention are refractory supports containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$; $CaAl_2O_4$; and (5) combinations of materials from one or more of these groups. The preferred refractory support for the first reforming catalyst is alumina, with gamma- or eta-alumina being particularly preferred. Best results are obtained with "Ziegler alumina," described in U.S. Pat. No. 2,892,858 and presently available from the Vista Chemical Company under the trademark "Catapal" or from Condea Chemie GmbH under the trademark "Pural." Ziegler alumina is an extremely high-purity pseudoboehmite which, after calcination at a high temperature, has been shown to yield a high-purity gamma-alumina. It is especially preferred that the refractory inorganic oxide comprise substantially pure Ziegler alumina having an apparent bulk density of about 0.6 to 1 g/cc and a surface area of about 150 to 280 $m^2/g$ (especially 185 to 235 $m^2/g$) at a pore volume of 0.3 to 0.8 cc/g.

The alumina powder may be formed into any shape or form of carrier material known to those skilled in the art such as spheres, extrudates, rods, pills, pellets, tablets or granules. Preferred spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The alternative extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, spherical particles can be formed from the extrudates by rolling the extrudate particles on a spinning disk.

An essential component of the first reforming catalyst is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 mass % of the catalytic composite, preferably 0.05 to 1 mass %, calculated on an elemental basis. It is within the scope of the present invention that the catalyst contains one or more metals known to modify the effect of the preferred platinum component. Such metal modifiers may include Group IVA (14) metals, other Group VIII (8-10) metals, rhenium, indium, gallium, zinc, uranium, dysprosium, thallium and mixtures thereof. Excellent results are obtained when the first reforming catalyst contains a tin component. Catalytically effective amounts of such metal modifiers may be incorporated into the catalyst by any means known in the art.

The first reforming catalyst may contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 wt. %. calculated on an elemental basis, of the final catalyst.

The reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially water-free reduction step at a temperature of about 300° to 550° C. for 0.5 to 10 hours or more. Further details of the preparation and activation of embodiments of the first reforming catalyst are disclosed in U.S. Pat. No. 4,677,094 (Moser et al.), which is incorporated into this specification by reference thereto.

The naphtha feedstock may contact the reforming catalyst in either upflow, downflow, or radial-flow mode. Since the present reforming process operates at relatively low pressure, the low pressure drop in a radial-flow reactor favors the radial-flow mode.

The catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or: (4) a hybrid system with semiregenerative and continuous-regeneration provisions in the same unit. The preferred embodiment of the present invention is a moving-bed reactor with continuous catalyst regeneration.

The first separation zone typically comprises one or more fractional distillation columns having associated appurtenances and performing separations at operating conditions known to those of ordinary skill in the art. The first separation zone removes a light product from the reformate in order to provide a suitable heavy reformate for subsequent processing. Preferably, the light product comprises butanes and lighter hydrocarbons, which are in the gaseous state at ambient temperature and atmospheric pressure, as well as noncondensable gases in the reformer effluent. These light components are removed usually in order to reduce the operating pressure required to maintain a liquid-phase operation in the second separation zone as well as to control the vapor pressure of the gasoline component produced from the present process combination. The heavy reformate from this step would consist primarily of $C_5$ and heavier hydrocarbons.

Optionally, a light naphtha fraction also is recovered in the first separation zone. In this embodiment, two fractional distillation columns usually are needed to separate light naphtha from heavy reformate and normally gaseous components from light naphtha; however, a single column from which light naphtha is recovered as a sidestream is known in the art. Preferably, the light naphtha will comprise pentanes either with or without a substantial concentration of $C_6$ hydrocarbons. In this embodiment, therefore, the heavy reformate consists primarily of either $C_6$ and heavier or $C_7$ and heavier hydrocarbons. Preferably the light naphtha is a $C_5/C_6$ fraction and the heavy reformate contains principally $C_7$ and heavier hydrocarbons.

The second separation zone may comprise either solvent extraction or adsorptive separation or a combination of solvent extraction and adsorptive separation in sequence to separate the heavy reformate into a low-octane paraffin fraction and an aromatic-rich fraction. Solvent extraction separates essentially all of the paraffins, as well as the relatively smaller amounts of olefins and naphthenes, from an aromatic concentrate. Adsorptive separation can selectively separate normal paraffins and optionally low-branched paraffins from other hydrocarbons. By low-branched paraffins are meant those with few carbon side chains, and especially those with only one methyl side chain. Solvent extraction thus produces a more concentrated aromatics stream, considering that essentially all of the paraffins are removed, while adsorptive separation produces a lower-octane paraffin fraction considering the following comparative RONs(Research octane numbers) of heptanes according to API Research Project 44:

| | |
|---|---|
| Normal heptane | 0 |
| Methyl hexanes | 42–65 |
| Dimethyl pentanes | 80–92 |

Since normal and singly branched paraffins generally constitute the preponderance of the paraffins in the heavy reformate, the entire paraffin fraction can be considered as "low-octane" relative to the aromatic concentrate which has an RON of over 100. Therefore, the paraffin concentrate from solvent extraction as well as the normal and low-branched paraffins from adsorption are each designated as "low-octane paraffin fractions." Preferably, however, the low-octane paraffins are recovered in the second separation zone by adsorptive separation while leaving the relatively higher-RON paraffins in the aromatic concentrate or producing them as a separate stream for gasoline blending.

Solvent extraction typically comprises contacting the heavy reformate in an extraction zone with an aromatic-extraction solvent which selectively extracts aromatic hydrocarbons. The aromatic hydrocarbons generally are recovered as extract from the solvent phase by one or more distillation steps, and the raffinate from extraction typically is purified by water washing. Solvent extraction normally will recover from about 90 to 100% of the aromatics from the reformate into the extract and reject from about 95 to 100% of the paraffins from the reformate into the raffinate.

Solvent compositions are selected from the classes which have high selectivity for aromatic hydrocarbons and are known to those of ordinary skill in the hydrocarbon-processing art. These generally comprise one or more organic compounds containing in their molecule at least one polar group, such as a hydroxyl-, amino-, cyano-, carboxyl- or nitro- radical, preferably selected from the aliphatic and cyclic alcohols, cyclic monomeric sulfones, glycols and glycol ethers, glycol esters and glycol ether esters. The mono- and poly-alkylene glycols in which the alkylene group contains from 2 to 4 carbon atoms constitute a satisfactory class of organic solvents useful in admixture with water as a solvent composition for use in the present invention. Other suitable solvents include sulfolane (tetrahydrothiophene 1,1-dioxide) and its derivatives, methyl-2-sulfonyl ether, N-aryl-3-sulfonylamine, 2-sulfonyl acetate, dimethylsulfoxide, N-methyl pyrrolidone and the like. Combining two or more of these solvents, particularly the low-molecular-weight polyalkylene glycols, can provide mixed extraction solvents having desirable properties.

Solvent-extraction conditions are generally well known to those trained in the art and vary depending on the particular aromatic-selective solvent utilized. Conventional conditions include an elevated temperature and a sufficiently elevated pressure to maintain the solvent reflux to the zone and the heavy reformate feed in the liquid phase. When using a solvent such as sulfolane, suitable temperatures are about 25° to 200° C., preferably about 80° to 150° C., and suitable pressures are about atmospheric to 30 atmospheres gauge and preferably about 3 to 10 atmospheres. Solvent quantities should be sufficient to dissolve substantially all of the aromatic hydrocarbons present in the heavy reformate feed to the extraction zone, and solvent-to-feed ratios by volume of about 2:1 to 10:1 are preferred. Heavier non-aromatic hydrocarbons are displaced from the extract phase at the lower end of the extraction zone by utilizing the known technique of recycling hydrocarbons from the overhead of the stripping column as reflux to the extraction zone.

When employing the preferred adsorptive separation step to process heavy reformate, normal paraffins and optionally low-branched paraffins are selectively adsorbed while other hydrocarbons are rejected into the raffinate. The aromatic-rich fraction as raffinate thus contains naphthenes and branched paraffins, particularly such as dimethyl, trimethyl and ethyl alkanes, in low concentrations relative to the aromatics content. The adsorptive separation uses one or more molecular sieves having pore sizes effective to adsorb the low-octane paraffins. Pore size is a key criterion in selection of molecular sieves for this step. Suitable molecular sieves will have a pore diameter greater than 4 Angstroms, but no more than about 6 Angstroms.

Adsorptive separation processes useful in the present invention may be classified by the range of paraffins adsorbed. One type of process separates normal paraffins from all other hydrocarbons, including both branched paraffins and cyclic hydrocarbons. This process generally uses an adsorbent known as 5A or calcium zeolite A to selectively adsorb the normal paraffins from the heavy-reformate feed stream. Aspects of this process are described, inter alia, in U.S. Pat. No. 4,036,745 and 4,210,771, incorporated herein by reference thereto. Normal paraffins have the lowest octane numbers of any hydrocarbon in any given carbon-number range, so the removal by adsorption of normal paraffins from a stream provides a substantial increase in octane number of the aromatic-rich adsorption raffinate as a gasoline-blending component.

Another type of adsorption process separates low-branched paraffins as well as normal paraffins from other hydrocarbons. Low-branched paraffins have only one or two tertiary carbons, and preferably are the mono-methyl paraffins. This type of process uses an adsorbent having a slightly larger pore size than the 5A zeolite to adsorb mono-methyl as well as normal paraffins, as described in U.S. Pat. No. 4,717,784. Mono-methyl paraffins have higher octane numbers than the corresponding normal paraffins, but generally lower than catalytic reformate or finished gasoline, and usually are present in reformate in greater concentrations than are normal paraffins. Therefore, adsorptive removal of mono-methyl paraffins will increase the octane number of the aromatic-rich raffinate from adsorption, but will also substantially reduce the yield of high-octane raffinate, relative to raffinate octane and yield when only normal paraffins are removed.

The adsorbent selected for use in the present process is preferably selected from one or more of the aforementioned 5A or calcium zeolite A; FER, MEL, MFI and MTT (IUPAC Commission on Zeolite Nomenclature); and the non-zeolitic molecular sieves of U.S. Pat. Nos. 4,310,440; 4,440,871; and 4,554,143. Especially preferred are 5A zeolite, FER, and ALPO-5 of U.S. Pat. No. 4,310,440.

The adsorbent may be employed in the process in the form of a fixed bed in which adsorption of the a low-octane paraffin fraction from the heavy-reformate feed is effected followed by displacement of the raffinate and desorption of the paraffins using a desorbent fluid. Preferably a higher-efficiency countercurrent or simulated moving-bed adsorption system is used, as described, inter alia, in U.S. Pat. Nos. 2,985,589 and 3,274,099. In the latter system, a rotary disc valve as described in U.S. Pat. Nos. 3,040,777 and 3,422,848 is preferably used to distribute input and output streams to and from the adsorption bed. The desorbent fluid usually is separated from the paraffins and raffinate and returned to the second separation zone. Liquid-phase operations are preferred due to lower required temperatures and resulting improved selectivities. Paraffin-adsorption conditions also comprise conditions suitable for desorption to recover a low-octane paraffinic fraction and include a temperature range of from about 20° to 250° C. and pressure within the range of atmospheric to about 30 atmospheres.

It is within the scope of the invention that a gasoline fraction from fluid catalytic cracking, or FCC gasoline, is processed in the second separation zone. In this alternative embodiment an additional paraffinic fraction is separated from the FCC gasoline preferably by adsorption, thereby upgrading the octane number of the raffinate remaining after extraction. FCC gasoline generally contains significant concentrations of olefins, sulfur, nitrogen and other materials which may deactivate catalysts and adsorbents. If an FCC-gasoline feedstock to the present process combination will be pretreated by catalytic hydrotreating or other suitable contaminant-removal processes, there is a substantial loss of octane number due to olefin saturation. Preferably, therefore, the FCC gasoline is processed in the second separation zone using an adsorbent which is relatively insensitive to such contaminants such as the silicalite of U.S. Pat. No. 4,061,724. The extract from this separation, containing most of the normal paraffins and preferably low-branched paraffins in the FCC gasoline, may be catalytically hydrotreated to produce a low-contaminant additional paraffinic fraction to the isomerization step described hereinbelow.

The low-octane paraffin fraction, preferably in admixture with hydrogen, is contacted with a paraffin-isomerizing catalyst in a paraffin-isomerization zone. The low-octane paraffins, as described hereinabove, comprise normal paraffins preferably in admixture with low-branched paraffins. The carbon chain lengths of the low-octane paraffins will be substantially within the range of 5 to 12, i.e., pentanes to dodecanes. Optionally, as described hereinabove, a light naphtha fraction has been separated from reformate prior to separation of the low-octane paraffins which then may comprise $C_6$ to $C_{12}$ paraffins. Preferably, the low-octane paraffins are substantially within the range of $C_7$ to $C_{10}$. If an additional paraffinic fraction is separated from FCC gasoline this optionally may be isomerized in the paraffin-isomerization zone in admixture with the low-octane paraffins.

The following discussion of conditions and catalysts applicable within an isomerization zone is applicable to a light-naphtha isomerization zone for isomerization of light naphtha as well as to the paraffin-isomerization zone, with exceptions and preferences as noted. It also is within the scope of the invention that an optional naphtha feedstock, for example a $C_5/C_6$ fraction derived from crude oil, is isomerized in the light-naphtha isomerization zone in admixture with the light naphtha fraction.

Contacting within the isomerization zone may be effected using the catalyst in a fixed-bed system, a moving-bed system, a fluidized-bed system, or in a batch-type operation. In view of the danger of attrition loss of the valuable catalyst and of operational advantages, it is preferred to use a fixed-bed system. In this system, a hydrogen-rich gas and the charge stock are preheated by suitable heating means to the desired reaction temperature and then passed into an isomerization zone containing a fixed bed of the catalyst particle as previously characterized. The isomerization zone may be in a single reactor or in two or more separate reactors with suitable means therebetween to insure that the desired isomerization temperature is maintained at the entrance to each zone. Two or more reactors in sequence are preferred to enable improved isomerization through control of individual reactor temperatures and for partial catalyst replacement without a process shutdown. The reactants may be contacted with the bed of catalyst particles in either upward, downward, or radial flow fashion. The reactants may be in the liquid phase, a mixed liquid-vapor phase, or a vapor phase when contacted with the catalyst particles, with excellent results being obtained by application of the present invention to a primarily liquid-phase operation.

Any catalyst known in the art to be suitable for the isomerization of paraffin-rich hydrocarbon streams may be used as a paraffin-isomerizing catalyst in the paraffin-isomerizing zone or a light-naphtha isomerization catalyst in the light-naphtha isomerization zone. A preferred paraffin-isomerizing catalyst comprises a platinum-group metal, hydrogen-form crystalline aluminosilicate and a refractory inorganic oxide. Best isomerization results are obtained when the composition has a surface area of at least 580 $m^2/g$. The preferred noble metal is platinum which is present in an amount of from about 0.01 to 5 mass % of the composition, and preferably from about 0.15 to 0.5 mass %. Catalytically effective amounts of one or more promoter metals preferably selected from Groups VIB(6), VII(8-10), IB(11), IIB(12), IVA(14), rhenium, iron, cobalt, nickel, gallium and indium also may be present. The crystalline aluminosilicate may be synthetic or naturally occurring, and preferably is selected from the group consisting of FAU, LTL, MAZ and MOR with mordenite having a silica-to-alumina ratio of from 16:1 to 60:1 being especially preferred. The crystalline aluminosilicate generally comprises from about 50 to 99.5 mass % of the composition, with the balance being the refractory inorganic oxide. Alumina, and preferably one or more of gamma-alumina and eta-alumina, is the preferred inorganic oxide. Further details of the composition are disclosed in U.S. Pat. No. 4,735,929, incorporated herein by reference thereto.

An alternative isomerization catalyst composition, especially preferred for light-naphtha isomerization, comprises one or more platinum-group metals, a halogen, and an inorganic-oxide binder. Preferably the catalyst contains a Friedel-Crafts metal halide, with aluminum chloride being especially preferred. The preferred platinum-group metal is platinum which is present in an amount of from about 0.1 to 0.5 mass %. The composition may also contain an organic polyhalo component, with carbon tetrachloride being preferred, and the total chloride content is from about 2 to 10 mass %. The inorganic oxide preferably comprises alumina, with one or more of gamma-alumina and eta-alumina being preferred. U.S. Pat. Nos. 2,999,074 and 3,031,419 teach additional aspects of this composition and are incorporated herein.

Water and sulfur are catalyst poisons especially for the chlorided platinum-alumina catalyst composition described hereinabove. Water can act to permanently deactivate the catalyst by removing high-activity chloride from the catalyst and replacing it with inactive aluminum hydroxide. Therefore, water and oxygenates that can decompose to form water can only be tolerated in very low concentrations. In general, this requires a limitation of oxygenates in the feed to about 0.1 mass ppm or less. Sulfur present in the feedstock serves to temporarily deactivate the catalyst by platinum poisoning. The present isomerization feed is not expected to contain a significant amount of sulfur, since it has been derived from a catalytic-reforming zone. If sulfur is present in the feed, however, activity of the catalyst may be restored by hot hydrogen stripping of the sulfur from the catalyst or by lowering the sulfur concentration in the incoming feed to below 0.5 mass ppm. The feed may be treated by any method that will remove water and sulfur compounds. Sulfur may be removed from the feed stream by hydrotreating. Adsorption systems for the removal of sulfur and water from hydrocarbon streams are well known to those of ordinary skill in the art.

The chlorided platinum-alumina catalyst described hereinabove also requires the presence of a small amount of an organic chloride promoter in the isomerization zone. The organic chloride promoter serves to maintain a high level of active chloride on the catalyst, as low levels are continuously stripped off the catalyst by the hydrocarbon feed. The concentration of promoter in the combined feed is maintained at from 30 to 300 mass ppm. The preferred promoter compound is carbon tetrachloride. Other suitable promoter compounds include oxygen-free decomposable organic chlorides such as propyldichloride, butylchloride, and chloroform, to name only a few of such compounds. The need to keep the reactants dry is reinforced by the presence of the organic chloride compound which may convert, in part, to hydrogen chloride. As long as the hydrocarbon feed and hydrogen are dried as described hereinabove, there will be no adverse effect from the presence of small amounts of hydrogen chloride.

Hydrogen is admixed with the feed to the isomerization zone to provide a mole ratio of hydrogen to hydrocarbon feed of about 0.01 to 5. The hydrogen may be supplied totally from outside the process or supplemented by hydrogen recycled to the feed after separation from reactor effluent. Light hydrocarbons and small amounts of inerts such as nitrogen and argon may be present in the hydrogen. Water should be removed from hydrogen supplied from outside the process, preferably by an adsorption system as is known in the art.

Although there is no net consumption of hydrogen in the isomerization reaction, hydrogen generally will be consumed in a number of side reactions such as cracking, disproportionation, and aromatics and olefin saturation. Such hydrogen consumption typically will be in a mol ratio to the hydrocarbon feed of about 0.03 to 0.1. Hydrogen in excess of consumption requirements is maintained in the reaction zone to enhance catalyst stability and maintain conversion by compensation for variations in feed composition, as well as to suppress the formation of carbonaceous compounds, usually referred to as coke, which foul the catalyst particles.

In a preferred embodiment, the hydrogen to hydrocarbon mol ratio in the reactor effluent is equal to or less than 0.05. Generally, a mol ratio of 0.05 or less obviates the need to recycle hydrogen from the reactor effluent to the feed. It has been found that the amount of hydrogen needed for suppressing coke formation need not exceed dissolved hydrogen levels. The amount of hydrogen in solution at the normal conditions of the reactor effluent will usually be in a ratio of from about 0.02 to less 0.01. The amount of excess hydrogen over consumption requirements that is required for good stability and conversion is in a ratio of hydrogen to hydrocarbons of from 0.01 to less than 0.05 as measured at the effluent of the isomerization zone. Adding the dissolved and excess hydrogen proportions show that the 0.05 hydrogen to hydrocarbon ratio at the effluent will satisfy these requirements for most feeds.

In an alternative embodiment, the paraffin-isomerization zone is operated at a substoichiometric hydrogen ratio. A stoichiometric hydrogen ratio is defined as the quantity of hydrogen relative to the low-octane paraffin fraction in the feed to the paraffin-isomerization zone that will result in a substantial ratio of hydrogen to hydrocarbon, e.g., 0.05 mol, in the reactor effluent. A substoichiometric hydrogen ratio is a quantity of hydrogen in the feed to the paraffin-isomerization zone substantially less than the stoichiometric hydrogen ratio at essentially the same conditions of pressure, temperature, and catalyst quantity and type. Preferably the substoichiometric hydrogen ratio is 90% or less, and optimally no more than about 70%, of the stoichiometric ratio. It has been found, surprisingly, that substoichiometric hydrogen can be applied in a stable paraffin-isomerization operation to increase the yield of heavy isomerized product to light cracked product.

Primary isomerization conditions in the paraffin-isomerization zone and secondary isomerization conditions in the light-naphtha isomerization zone include reactor temperatures usually ranging from about 40° to 250° C. Lower reaction temperatures are generally preferred since the equilibrium favors higher concentrations of isoalkanes relative to normal alkanes. Lower temperatures are particularly desirable in order to favor equilibrium mixtures having the highest concentration of high-octane highly branched isoalkanes and to minimize cracking of the feed to lighter hydrocarbons. Temperatures in the range of from about 40° to about 150° C. are preferred in the present invention.

Reactor operating pressures generally range from about atmospheric to 100 atmospheres, with preferred pressures in the range of from 20 to 35 atmospheres. Liquid hourly space velocities range from about 0.25 to about 12 volumes of isomerizable hydrocarbon feed per hour per volume of catalyst, with a range of about 0.5 to 5 $hr^{-1}$ being preferred.

The isomerization product from the especially preferred light-naphtha feedstock will contain some low-octane normal paraffins and intermediate-octane methylhexanes as well as the desired highest-octane isopentane and dimethylbutane. It is within the scope of the present invention that the liquid product from the process is subjected to separate and recycle the lower-octane portion of this product to the isomerization reaction. Generally, low-octane normal paraffins may be separated and recycled to upgrade the octane number of the net product. Less-branched $C_6$ and $C_7$ paraffins also may be separated and recycled, along with lesser amounts of hydrocarbons which are difficult to separate from the recycle. Techniques to achieve this separation are well known in the art, and include fractionation and molecular sieve adsorption.

At least a portion of the aromatic-rich fraction from the second separation zone and the isomerized heavy-paraffin product from the paraffin-isomerization zone are blended to produce a gasoline component. Preferably, the component comprises all of the aromatic-rich fraction and the isomerized heavy-paraffin product produced by the present process combination. An optional component of the gasoline component is the isomerized light product produced by isomerization of the light naphtha fraction. Finished gasoline may be produced by blending the gasoline component with other constituents including but not limited to one or more of butanes, butenes, pentanes, naphtha, catalytic reformate, isomerate, alkylate, polymer, aromatic extract, heavy aromatics; gasoline from catalytic cracking, hydrocracking, thermal cracking, thermal reforming, steam pyrolysis and coking; oxygenates such as methanol, ethanol, propanol, isopropanol, TBA, SBA, MTBE, ETBE, MTAE and higher alcohols and ethers; and small amounts of additives to promote gasoline stability and uniformity, avoid corrosion and weather problems, maintain a clean engine and improve driveability. The order of blending is not critical to the invention, i.e., the aforementioned constituents may be blended with the aromatic-rich fraction or isomerized heavy-paraffin product before these are combined into the present gasoline component, since this order of blending will not affect the utility of the gasoline component in the blending of finished gasoline.

If the total aromatic-rich fraction and isomerized heavy-paraffin product, along with any isomerized light product produced by the optional light-naphtha isomerization step, are blended into the gasoline component, the aromatics content of the component will be substantially lower than the aromatics content of a catalytic reformate produced from the naphtha feedstock at the same octane number. The reduction in aromatic content may amount to 5 to 30 volume % of the gasoline component, or more usually 10 to 25%. Stated in another way, if the total $C_5$+ product from the present combination is blended and the octane number is measured, and if the naphtha feedstock is catalytically reformed at the same operating pressure as the reforming pressure of the present process combination to yield product having the same octane number as the present blended $C_5$+ product, the present invention will yield a reduced product-aromatics content. This reduction in aromatics content is desirable, since future "reformulated" gasolines are likely to require reductions in aromatics content as well as vapor pressure, olefins and heavy components (*Chemical Engineering*, January, 1990, pp. 30–35). Since catalytic reformate comprises generally over 30% of the U.S. gasoline pool, and since aromatics have been a major contributor to maintaining U.S. gasoline octane as lead additives have been removed, a process combination effective for the reduction of the aromatics content of gasoline while maintaining octane number should find utility in the industry.

EXAMPLES

The following examples serve to illustrate certain specific embodiments of the present invention. These examples should not, however, be construed as limiting the scope of the invention as set forth in the claims. There are many possible other variations, as those of ordinary skill in the art will recognize, which are within the spirit of the invention.

EXAMPLE 1

The benefits of producing a gasoline component using the process combination of the invention are illustrated by contrasting results with those from a process of the prior art: Example 1 presents results from the prior-art process.

The feedstock used in all examples is a full-range naphtha derived from Arabian Light crude oil and having the following characteristics:

| | |
|---|---|
| Specific gravity | 0.742 |
| Distillation, ASTM D-86, °C. | |
| IBP | 84 |
| 50% | 132 |
| EP | 184 |
| Volume % | |
| paraffins | 71.0 |
| naphthenes | 19.8 |
| aromatics | 9.2 |

The prior-art process is a reforming operation using a chlorided platinum-tin-alumina catalyst. Operating pressure was established as 3.4 atmospheres gauge, consistent with modern high-yield reforming designs employing continuous catalyst regeneration. Temperature and space velocity were adjusted to achieve the product octane numbers described hereinafter. Product octane number was characterized as RON (Research Octane Number, ASTM D-2699).

Pertinent results for comparison with the process of the invention were determined from correlations of pilot-plant data from the processing of the above feedstock, and are as follows:

| | | |
|---|---|---|
| Product RON clear | 100 | 102 |
| $C_5$+ product yield, vol. % | 78.3 | 75.7 |
| Aromatics in $C_5$+ product, vol. % | 65 | 71 |

EXAMPLE 2

Isomerization of heavy paraffins derived from catalytic reforming of naphtha was demonstrated on a raffinate feedstock derived from glycol extraction of a catalytic reformate. The raffinate had the following characteristics:

| Volume %: | |
|---|---|
| $C_6$ paraffins | 32.0 |
| $C_7$ paraffins | 44.2 |
| $C_8$+ paraffins | 11.7 |
| Total paraffins | 87.9 |
| naphthenes | 6.6 |
| aromatics | 5.5 |
| RON clear | 55.2 |

Figure 2:
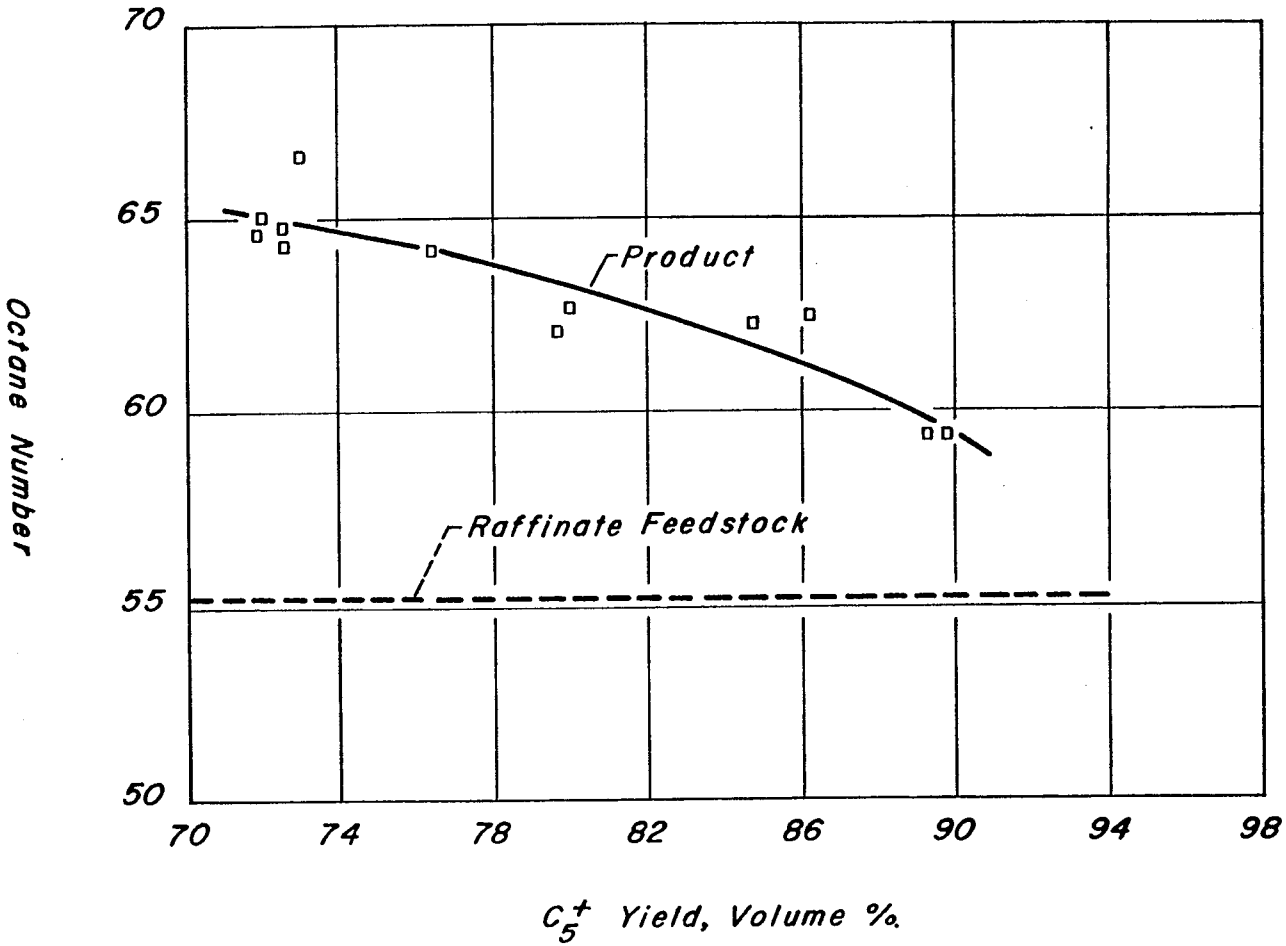
FIG. 2 shows the relationship of product octane to $C_5+$ yield for the isomerization of heavy paraffins.

The raffinate was isomerized at about 14 atmospheres gauge and 1 LHSV (liquid hourly space velocity) over a catalyst consisting essentially of platinum on a composite of mordenite and gamma alumina in accordance with the teachings of U.S. Pat. No. 4,735,929. Temperature was varied to give a range of conversions. The resulting relationship of product octane of $C_5$+ yield is shown in FIG. 2. Product octanes range from about 59 to 67 while $C_5$+ yield ranges from 72 to 90 volume % of the fresh feed.

EXAMPLE 3

The process combination of the invention is exemplified using the same feedstock as described hereinabove in Example 1. Overall yields and product properties are determined based on a reformer feed quantity of 10,000 B/SD (barrels per stream day). Reformate yield, based on the catalyst and pressure of Example 1 and an operating severity to achieve a $C_5$+ product RON clear of 92, is 8500 B/SD. A concentrate of singly branched and normal paraffins is recovered from the $C_5$+ reformate by molecular-sieve extraction and separated into a $C_5/C_6$ cut and a $C_7$+ cut. The relative quantities are approximately as follows:

| | |
|---|---|
| $C_5$+ reformate | 8500 |
| $C_5/C_6$ paraffins | 1380 |
| $C_7$+ paraffins | 1560 |
| Aromatic concentrate | 5560 |

The $C_5/C_6$ paraffins are isomerized in a once-through operation employing a chlorided platinum-on-alumina catalyst in accordance with the teachings of U.S. Pat. No. 2,900,425. Yields and product properties are derived from pilot-plant and commercial operations and correlations on similar stocks. The $C_7$+ paraffins are isomerized with a catalyst comprising platinum on mordenite and gamma alumina in accordance with the teachings of U.S. Pat. No. 4,735,929. Operating conditions, yields and product isomer distribution are consistent with Example 2 and related pilot-plant results. The products of $C_5/C_6$ and $C_7$+ isomerization are blended with the aromatic concentrate to yield a gasoline component as follows:

| | |
|---|---|
| $C_5/C_6$ product | 1375 |
| $C_7$+ product | 1170 |
| Aromatic concentrate | 5560 |
| Total component | 8105 |
| RON clear | 100.7 |

-continued

| | |
|---|---|
| Volume % aromatics | 54 |

EXAMPLE 4

The reforming operations and paraffin cuts to isomerization are identical to those of Example 3. Example 4 differs in that the $C_5/C_6$ isomerization is a recycle operation, with the separation and recycle of low-octane paraffins from the isomerization product. The recycle comprises primarily singly branched and normal paraffins recovered from the isomerization product by molecular-sieve extraction.

The products of the recycle $C_5/C_6$ and once-through $C_7$+ isomerization are blended with the aromatic concentrate to yield a gasoline component as follows:

| | |
|---|---|
| $C_5/C_6$ product | 1350 |
| $C_7$+ product | 1170 |
| Aromatic concentrate | 5560 |
| Total component | 8080 |
| RON clear | 103.0 |
| Volume % aromatics | 55 |

EXAMPLE 5

Results from Examples 1, 3 and 4 are compared to assess the utility of the invention. Comparable product yields and aromatic contents of prior-art reforming operations are estimated by extrapolation of the Example 1 results to compare with invention results at the same product RON (octane number). The comparison is as follows:

| | Prior Art | | Invention | |
|---|---|---|---|---|
| RON Clear | 100 | 102 | 100.7 | 103.0 |
| $C_5$+ Yield, Vol. % | 78.3 | 75.7 | 81.0 | 80.8 |
| Prior-Art Yield Equiv. | | | 77.4 | 73.1 |
| Aromatics, Vol. % | 65 | 71 | 54 | 55 |
| Prior-Art Aromatics | | | 67 | 74 |

Thus, the process combination of the invention improves $C_5$+ product yields by about 3–8% and reduces product aromatics content by about 25–30%. If reformulated gasoline eventually is limited to 20 volume % maximum aromatics content and the above products are the only aromatics-containing components, the gasoline components of the invention could comprise about 37 volume % of the finished gasoline while the prior-art products would be limited to 27–30 volume % of the finished gasoline.

EXAMPLE 6

Isomerization of heavy paraffins at a substoichiometric hydrogen ratio was demonstrated in comparison to a control case using stoichiometric hydrogen. The feedstock was substantially pure normal octane (n-octane) having a Research octane number of about −10. In both the substoichiometric-hydrogen and control cases, the feedstock was isomerized at the same operating conditions of pressure of about 30 atmospheres gauge, temperature of 116° C., and 1 LHSV (liquid hourly space velocity). The catalyst in both cases contained platinum, aluminum chloride, and gamma alumina as described hereinabove and in accordance with the teachings of U.S. Pat. No. 2,999,074 and 3,031,419.

Yields were calculated on the basis of recovering and recycling unconverted n-octane in the product:

| | | |
|---|---|---|
| Hydrogen/hydrocarbon, mols | 0.14 | 1.0 |
| Mass %: | | |
| $C_4$ and lighter | 32 | 82 |
| $C_5$ paraffins | 14 | 13 |
| $C_6/C_7$ paraffins | 11 | 5 |
| $C_8$ iosparaffins | 43 | — |
| Total $C_5$+ paraffins | 68 | 18 |
| RON clear | 55 | 84 |
| Combined feed ratio, mass | 2.7 | 1.0 |

Isomerization at a substoichiometric hydrogen ratio demonstrated a significantly higher yield of $C_5$+ product relative to operation at a stoichiometric hydrogen ratio. Relative product octane was nearly 30 numbers lower for the substoichiometric operation due principally to the presence of isomerized $C_8$ paraffins, but about 65 numbers higher than that of the n-octane feed. Separation and recycle of singly branched and lighter paraffins would be expected to result in yields and octanes intermediate between the above cases.

EXAMPLE 7

Isomerization of heavy paraffins at alternative temperatures at a substoichiometric hydrogen ratio was demonstrated. The feedstock was substantially pure normal octane (n-octane), having a Research octane number of about −10, as in Example 6. The feedstock was isomerized at a pressure of about 30 atmospheres gauge and 1 LHSV. The catalyst in both cases contained platinum, aluminum chloride, and gamma alumina as described hereinabove and in accordance with the teachings of U.S. Pat. No. 2,999,074 and 3,031,419. Yields were calculated on the basis of recovering and recycling unconverted n-octane in the product:

| | | |
|---|---|---|
| Hydrogen/hydrocarbon, mols | 0.14 | 0.56 |
| Temperature, °C. | 75 | 50 |
| Mass %: | | |
| $C_4$ and lighter | 24 | 31 |
| $C_5$ paraffins | 16 | 9 |
| $C_6/C_7$ paraffins | 18 | 9 |
| $C_8$ isoparaffins | 42 | 51 |
| Total $C_5$+ paraffins | 76 | 69 |
| RON clear | 59 | 53 |
| Combined feed ratio, mass | 1.75 | 1.5 |

We claim as our invention:

1. A process for isomerizing a low-octane paraffin fraction substantially within the range of $C_7$ to $C_{10}$ in a paraffin-isomerization zone at primary isomerization conditions with a paraffin-isomerizing catalyst at a substoichiometric hydrogen ratio which is 90% or less of the stoichiometric ratio to produce an isomerized heavy-paraffin product.

2. The process of claim 1 wherein the low-octane paraffin fraction contains primarily normal paraffins.

3. The process of claim 1 wherein the low-octane paraffin fraction contains primarily normal and low-branched paraffins.

4. The process of claim 1 wherein the paraffin-isomerizing catalyst comprises a platinum-group metal, a Friedel-Crafts metal halide and a refractory inorganic oxide.

5. The process of claim 1 wherein the paraffin-isomerizing catalyst comprises a platinum-group metal, a hydrogen-form crystalline aluminosilicate and a refractory inorganic oxide.

6. The process of claim 1 wherein the substoichiometrichydrogen ratio is 70% or less of the stoichiometric ratio.

7. A process combination for producing a gasoline component from a naphtha feedstock comprising the steps of:

(a) contacting the naphtha feedstock in a reforming zone at reforming conditions with a reforming catalyst comprising a Group VIII metal on a refractory support to produce a reformate and a hydrogen-rich gas;

(b) separating the reformate, in a first separation zone, in to a light hydrocarbon product and a heavy reformate;

(c) separating the heavy reformate, in a second separation zone, into a low-octane paraffin fraction and an aromatic-rich fraction;

(d) contacting the low-octane paraffin fraction substantially within the range of $C_7$ to $C_{10}$ in a paraffin-isomerization zone at primary isomerization conditions with a paraffin-isomerizing catalyst at a substoichiometric hydrogen ratio which is 90% or less of the stoichiometric ratio to produce an isomerized heavy-paraffin product; and, (e) combining at least a portion of each of the aromatic-rich fraction and the isomerized heavy-paraffin product to produce the gasoline component.

8. The process of claim 7 wherein the light hydrocarbon product of step (b) comprises a light naphtha fraction and a normally gaseous effluent.

9. The process of claim 8 wherein the light naphtha fraction is contacted in a light-naphtha isomerization zone at secondary isomerization conditions with a light-naphtha isomerization catalyst to produce an isomerized light product.

10. The process of claim 9 wherein the gasoline component comprises at least a portion of the isomerized light product.

11. The process of claim 7 wherein the low-octane paraffin fraction contains primarily normal paraffins.

12. The process of claim 7 wherein the low-octane paraffin fraction contains primarily normal and low-branched paraffins.

13. The process of claim 7 wherein the first separation zone comprises a reformate-distillation zone.

14. The process of claim 7 wherein the second separation zone comprises a solvent-extraction zone operating at solvent-extraction conditions.

15. The process of claim 7 wherein the second separation zone comprises a paraffin-adsorption zone operating at paraffin-adsorption conditions.

16. The process of claim 7 wherein the paraffin-isomerizing catalyst of step (d) comprises a platinum-group metal, a Friedel-Crafts metal halide and a refractory inorganic oxide.

17. The process of claim 7 wherein the paraffin-isomerizing catalyst of step (d) comprises a platinum-group metal, a hydrogen-form crystalline aluminosilicate and a refractory inorganic oxide.

18. The process of claim 17 wherein the hydrogen-form crystalline aluminosilicate comprises mordenite.

19. The process of claim 7 wherein the paraffin-isomerizing catalyst of step (d) comprises at least one non-zeolitic molecular sieve.

20. A process combination for producing a gasoline component from a naphtha feedstock comprising the steps of:

(a) contacting the naphtha feedstock in a reforming zone at reforming conditions with a reforming catalyst comprising a Group VIII metal on a refractory support to produce a reformate and a hydrogen-rich gas;

(b) separating the reformate, in a first separation zone, into a normally gaseous fraction, a light naphtha fraction and a heavy reformate;

(c) contacting the light naphtha fraction in a light-naphtha isomerization zone at secondary isomerization conditions with a light-naphtha isomerization catalyst to produce an isomerized light product.

(d) separating the heavy reformate, in a paraffin-adsorption zone, into a low-octane paraffin fraction and an aromatic-rich fraction;

(e) contacting the low-octane paraffin fraction substantially within the range of $C_7$ to $C_{10}$ in a paraffin-isomerization zone at primary isomerization conditions with a paraffin-isomerizing catalyst at a sub-stoichiometric hydrogen ratio which is 90% or less of the stoichiometric ratio to produce an isomerized heavy-paraffin product; and, (f) combining at least a portion of each of the aromatic-rich fraction, the isomerized light product and the isomerized heavy-paraffin product to produce the gasoline component.

* * * * *